US006688241B1

(12) United States Patent
Reilly

(10) Patent No.: US 6,688,241 B1
(45) Date of Patent: Feb. 10, 2004

(54) MICROFICHE EMERGENCY DESTRUCT SYSTEM

(75) Inventor: Raymond E. Reilly, Fairfax, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 05/484,506

(22) Filed: Jun. 27, 1974

(51) Int. Cl.[7] ..... E05G 1/00
(52) U.S. Cl. ..... 109/29
(58) Field of Search ..... 109/20, 29, 30, 109/31, 32, 33, 34, 36, 37, 53

(56) References Cited

U.S. PATENT DOCUMENTS 2,190,229 A * 2/1940 Bradley ..... 109/53
3,688,708 A * 9/1972 Meyerhoefer ..... 109/29

* cited by examiner

*Primary Examiner*—Michael J. Carone
(74) *Attorney, Agent, or Firm*—John J. Karasek; George A. Kap

(57) ABSTRACT

An emergency destruct system for destroying the information on microfiches attached to cards stored in security containers like the drawers of a combination lock safe. The system includes a storage tray for the cards, a tank holding fluid which can dissolve the emulsion on the microfiches, a release port assembly on the bottom of the tank and means for actuating the assembly to open the port and release the fluid contained therein.

The tray contains styrofoam spacers which form compartments to store the microfiche cards, is open at the sides and is placed in the bottom of the drawer.

The tank is held above the tray by a retaining member which is affixed to the upper drawer separator.

The back of the drawer is cut off and a rubber pad is secured to the back of the safe to form a back for the drawer when it is in the fully closed position.

The release port assembly includes a prestressed glass disc, some gaskets, a spring member and a retaining member, the glass disc keeping the fluid in the tank from dropping out on the tray.

When ready to destroy the microfiche a piston is made to strike the edge of the prestressed glass, shattering it and allowing the spring to propel the glass into the tray, thereby opening the release port.

The piston is part of a piston motor which has a resistance wire surrounded by an explosive charge. An electrical impulse generator is squeezed to send current into the resistance wire. The current heats the wire and this explodes the charge causing the piston to strike the glass.

Preferably, the tray fits into a liner which fits into the drawer, the upper space of the liner accommodating the tank. The rear of the liner is excised so that the rear of the liner does not contact the tank when the drawer is pulled out.

7 Claims, 6 Drawing Sheets

MICROFICHE EMERGENCY DESTRUCT SYSTEM

BACKGROUND OF THE INVENTION

This invention relates to the destruction of file data and especially to the rapid destruction of information contained on microfiche stored in standard security file containers.

One means of storing classified data is to photograph it on microfiche, place a plurality of the microfiche units on a larger card and store the cards in the drawers of standard security file containers (or drawers) such as those manufactured by the Mosler Safe Company of Hamilton, Ohio.

Since hundreds or thousands of pieces of microfiche may be stored in a single safe, it becomes a difficult problem to eradicate the information on all the microfiches quickly, as must be done in emergency situations where the safe might fall into enemy hands. Present methods are unsatisfactory for various reasons.

SUMMARY OF THE INVENTION

The objects and advantages of the present invention are attained by loading microfiche cards into a storage tray inside a liner in the drawer of a safe, placing a tank containing fluid which is able to dissolve the information-containing emulsion on the microfiches over the tray, placing a release port opening in the bottom of the tank and a release port assembly which closes the opening but can be opened by an actuating assembly, the latter being operable from outside the safe.

An object of this invention is to destroy the information on microfiches which are stored within a locked safe, or security container.

Another object is to permit such destruction to be accomplished rapidly and without danger to personnel.

A further object is to permit such destruction to be initiated from outside a locked safe, or security container.

Other objects, advantages, and novel features of the present invention will become apparent from the following detailed description of the invention when considered in conjunction with the accompanying drawings.

DETAILED DESCRIPTION OF THE INVENTION

Figure 1:
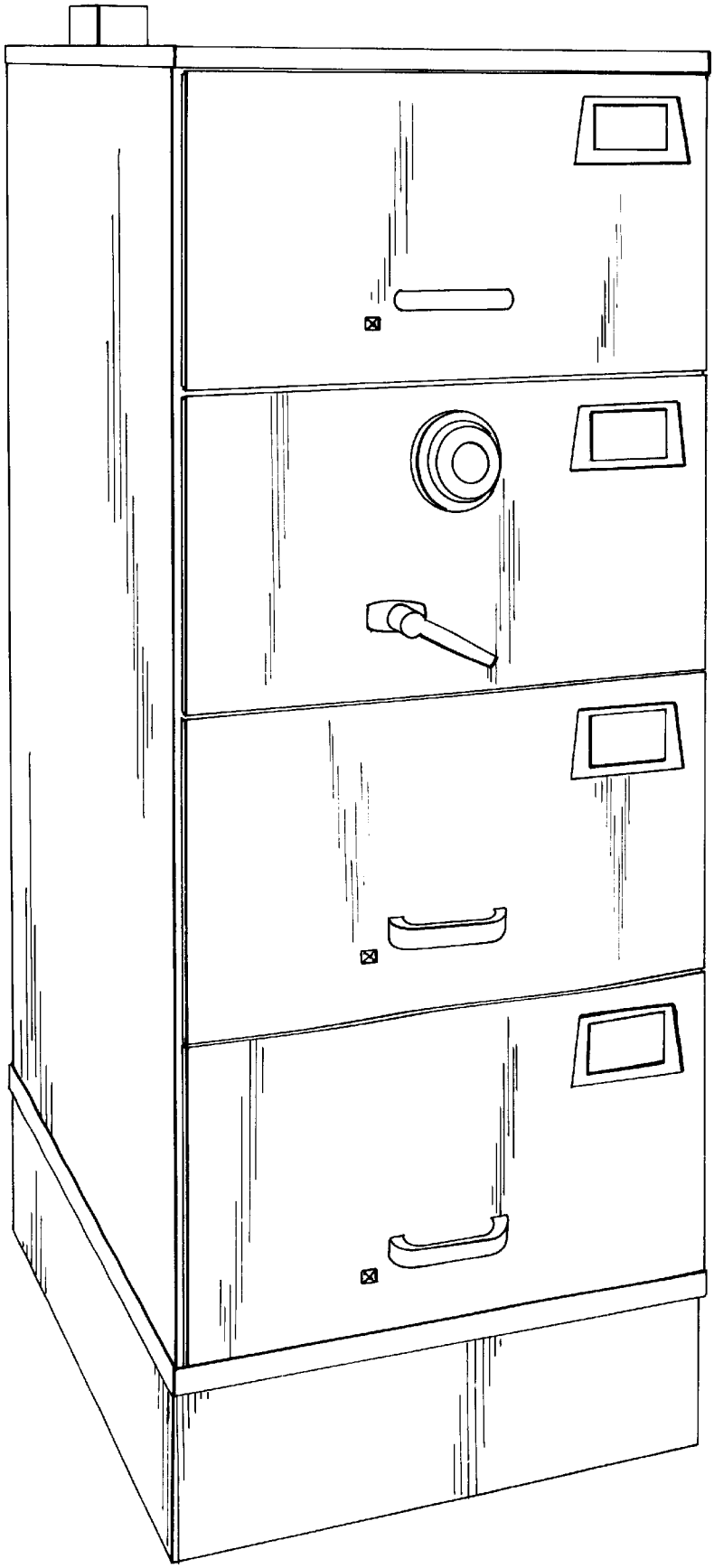
FIG. 1 is an isometric view of a safe with which the invention may be used.

The microfiche emergency destruct system is made for the purpose of destroying microfiche (a small sheet of photographic film containing information or pictures) stored inside a safe drawer. A typical safe is the General Service Administration Approved Security Container, Mosler, shown in FIG. 1. This is a combination-lock safe with drawers for storage purposes.

The invention comprises a liner for the drawer, a microfiche storage tray which is placed at the bottom of the liner, aa tank for holding the destructive solution, means for supporting the tank and means for releasing the fluid from the tank into the storage tray.

Figure 2:
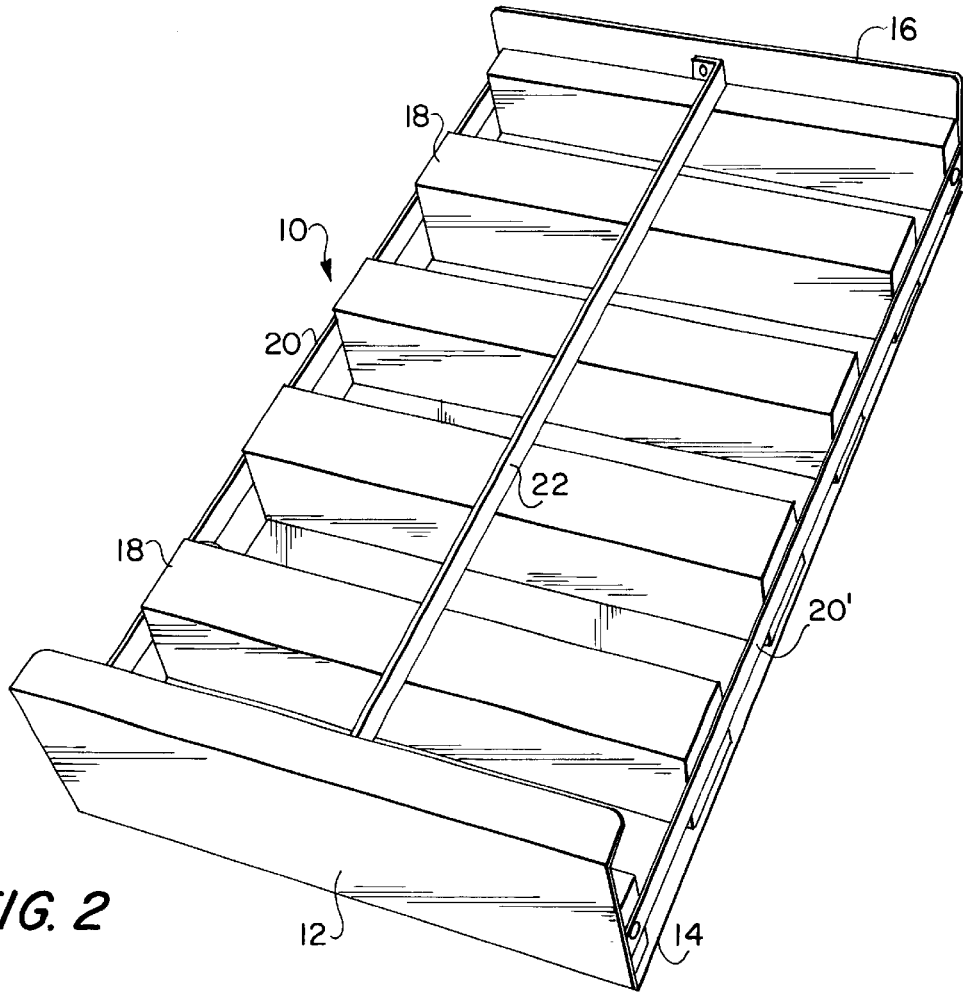
FIG. 2 is an isometric view of a storage tray.

The storage tray 10 is shown in FIG. 2. The front 12, bottom 14, and rear 16 of the tray 10 are formed from sheet aluminum. Spacers 18, preferably of styrofoam but of anything which is rigid and which the destructive solution will dissolve, are placed inside the tray. The spacers 18 are held in place by side strips 20 and 20' and a top strip 22 of aluminum.

Figure 3:
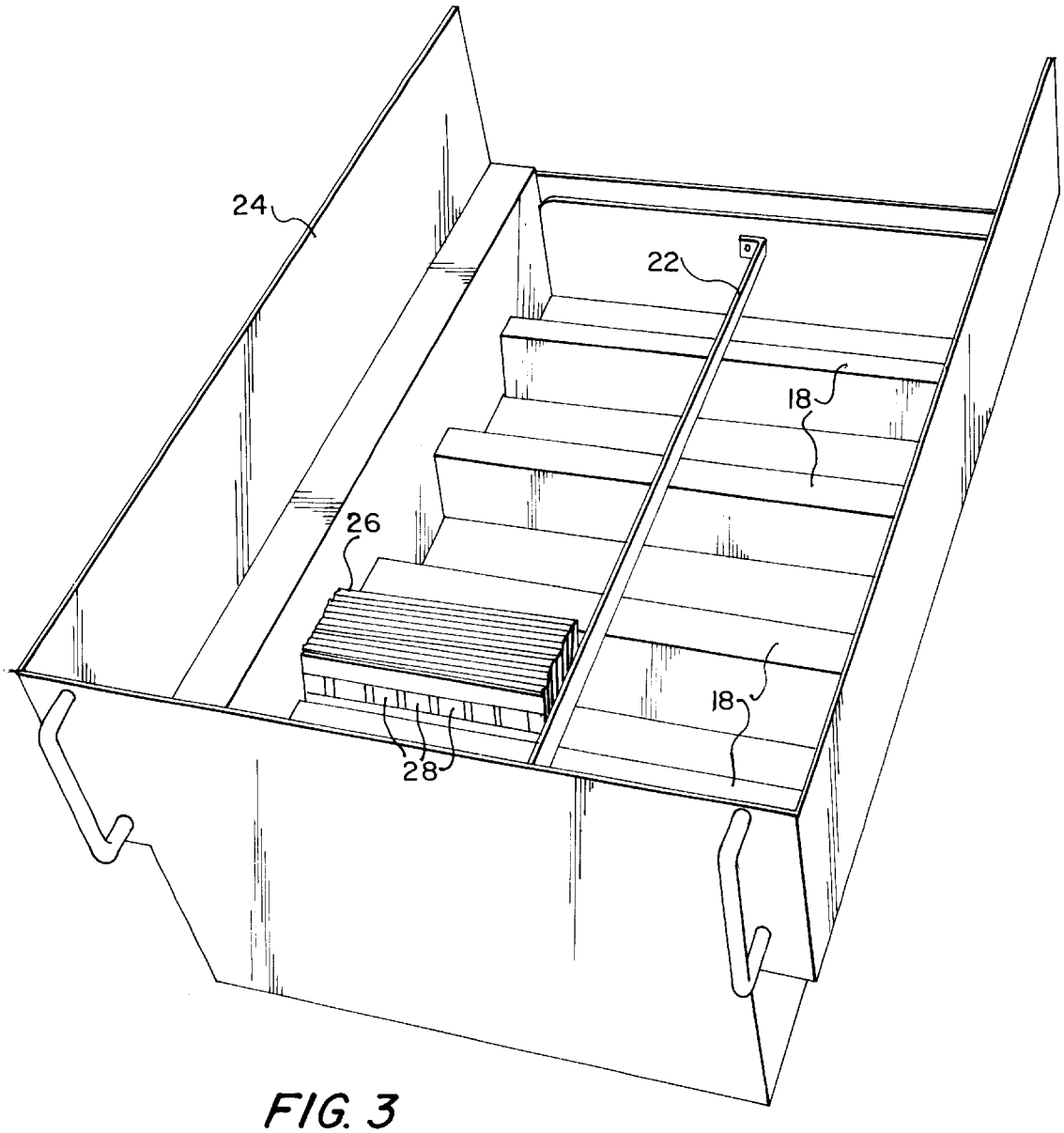
FIG. 3 is an isometric view of a liner with a tray and microfiche cards inside.
Figure 4:
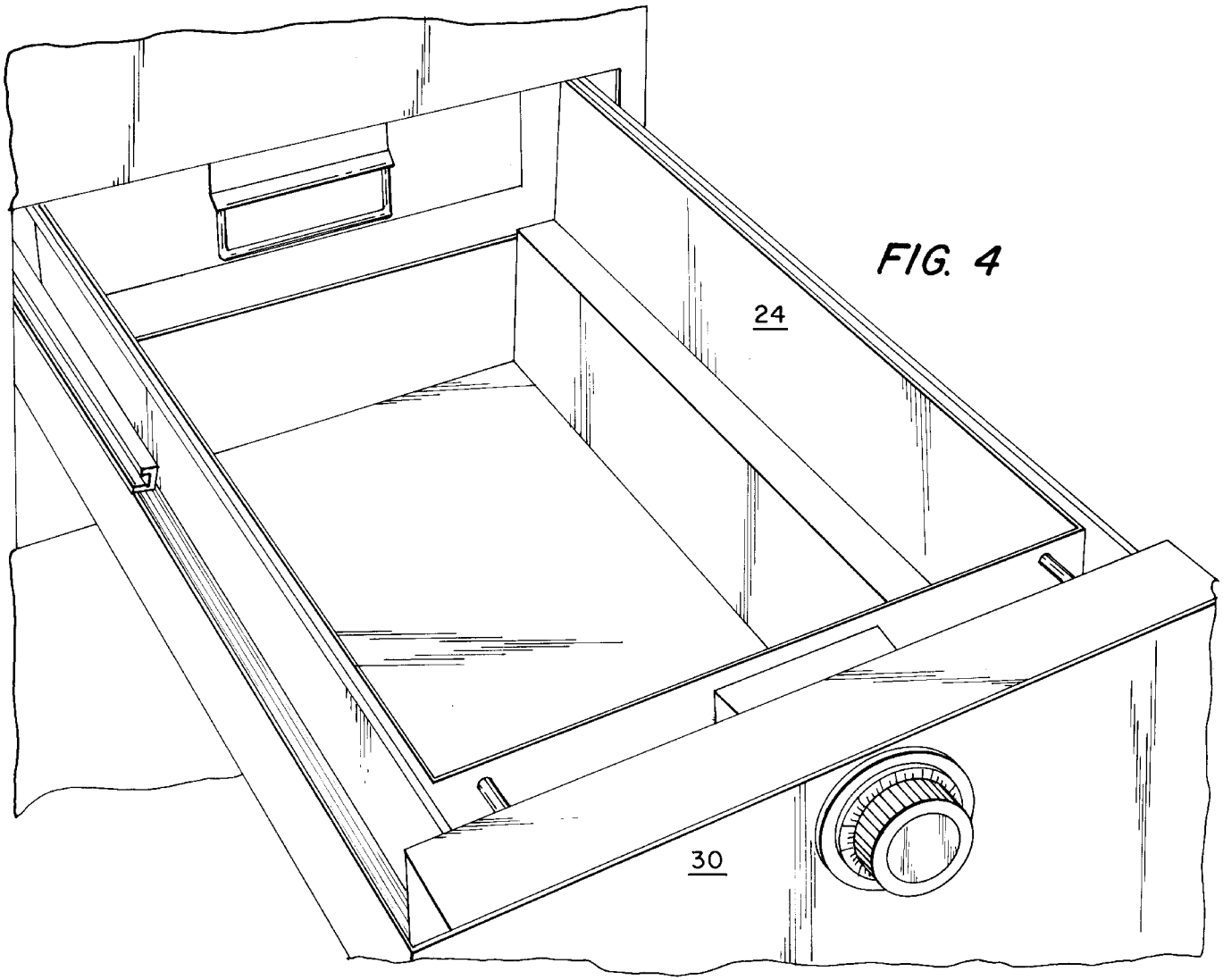
FIG. 4 is an isometric view of a liner inside a safe drawer which is extended from the safe. The front of the tank can also be seen.

The storage tray 10 fits into the bottom of a liner 24 as shown in FIG. 3. Cards 26 to which microfiche 28 is secured are ordinarily placed in the empty spaces between the spacers 18. The sides and front of the liner reach to the top edge of the safe drawer 30 as shown in FIG. 4. The bottom half of the liner is smaller in width than the top half to make sure that the fluid volume in the tank fills the entire volume of the bottom half which contains the microfiche tray 10, so that the fluid efficiently surrounds the microfiche. The top half of the back of the liner 24 is cut away so that, when the drawer is pulled out with the liner, there is no interference with the tank 32 which sits in the top half of the liner but does not pull out with the drawer.

Figure 6:
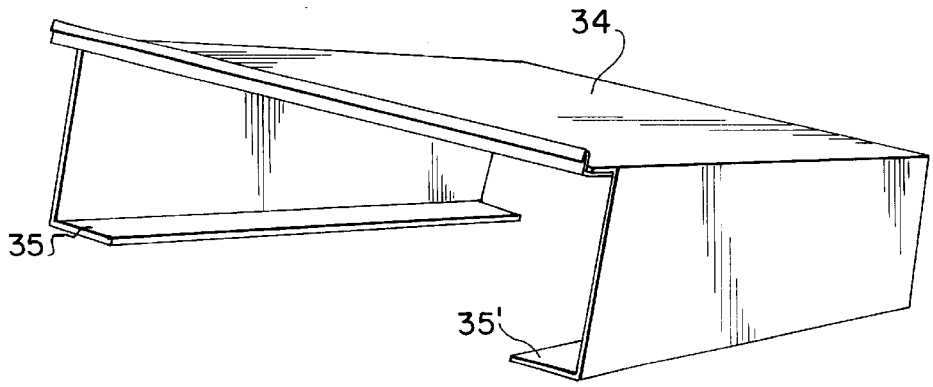
FIG. 6 is an isometric view of a tank retainer.
Figure 5:
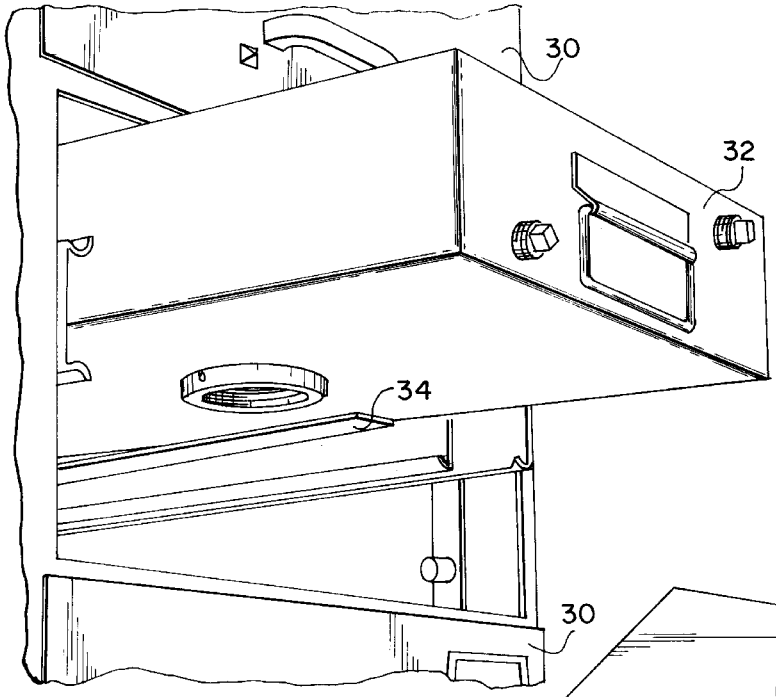
FIG. 5 is an isometric view of a safe with a tank extending forward from its retainer. The fluid release port in the bottom of the tank is visible.

The tank 32 (FIG. 5) fits into a tank retainer 34 (FIGS. 5 and 6) which can be made of sheet metal or plastic. The tank retainer 34 has a top and two sides, the top being affixed to the bottom of the upper side of the safe frame if the tank is in the top compartment of the safe, or to the bottom of the separator between the safe compartment in which the retainer is located and the next higher safe compartment, if the retainer is not in the top compartment. The retainer 34 can be welded if it is metal. The sides are bent inwardly at the bottom to form supporting flanges 30 and 35' for the tank. 32, which slides into the tank retainer 34 as shown in FIG. 5.

Each drawer 30 normally has a back. This back is cut away so that the drawer can be pulled out with the tank 32 in place inside the drawer 30. A piece of foam rubber (not shown) is cemented to the back of the safe so that back of the drawer 30 and the back of the liner 24 fit snugly against the foam rubber which makes the liner 24 fluidtight at the rear. The tank 32 may be made of any material which will hold the dissolving fluid, such as stainless steel, for example, and is simply a rectangular box in shape.

The dissolving fluid may be anything which will dissolve the emulsion on the microfiche film such as methylene chloride, for example, which is preferred because it is also non-toxic to humans.

Figure 7:
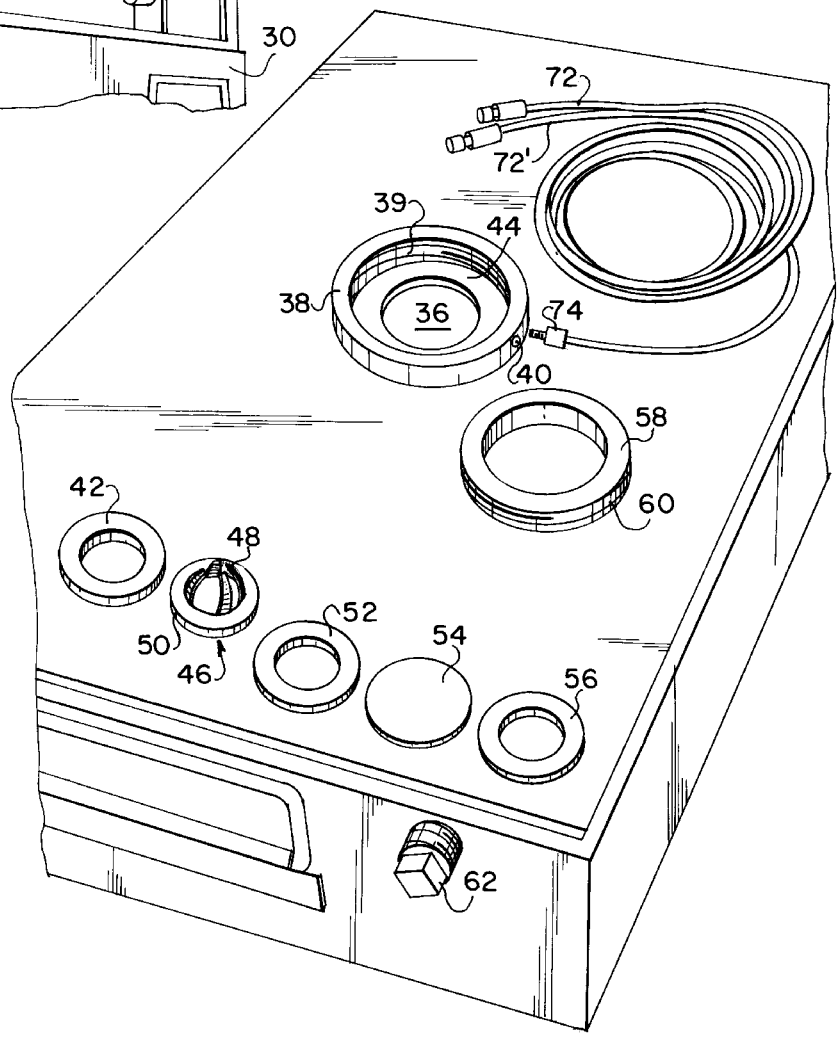
FIG. 7 is an isometric view of a tank showing the release port. All the elements of the release assembly are shown in disassembled fashion.

The tank 32 has a port 36 in its bottom surface (FIGS. 5 and 7) with a stainless steel collar 38 surrounding it. The inside of the collar is threaded and the collar has a threaded hole 40 on its left side (left when facing the front of the safe with the tank in place in its retainer).

A gasket 42, preferably of teflon, is coated on both sides with a thin layer of silicone jelly (e.g., Dow Corning DC-4) for the purpose of fluid-proofing and placed on the shoulder 44 inside the collar. A metal spring 46 (FIG. 8) with four arcuate fingers 48, equally spaced and depending from a gasket-shaped ring 50 is inserted with fingers pointing upward (upward with respect to FIG. 7 which shows the bottom surface of the tank on top for the purpose of assembling the parts of the release port). Both sides of a second teflon gasket 52 are now covered with a thin layer of silicone jelly and the gasket is placed on top of the spring fingers. A glass disc 54 made of prestressed glass is placed on top of the second gasket 52. A third teflon gasket 56 is covered with silicone jelly and placed on top of the glass disc 54. A retaining ring 58, which is threaded on the outside, is now screwed into the collar 38 and the whole assembly is tightened down firmly.

The tank 32 has a filling port on its front and a screw-in plug 62. The plug 62 is made fluidtight by wrapping teflon thread-sealing tape (not shown) around the threads. One or two turns of tape is sufficient. After filling the tank with a 100% solution of liquid methylene chloride, the plug is installed and tightened with a wrench.

Figure 8:
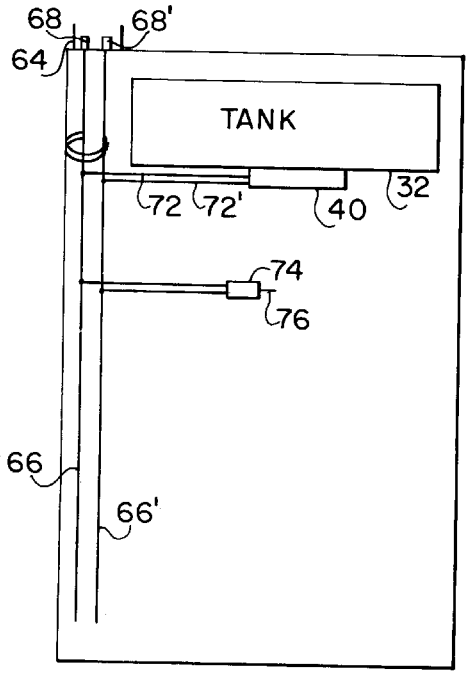
FIG. 8 is a schematic view of part of the cabling inside a safe.

A set of two insulated wires, or cables, 66 and 66', runs down inside the left side of the safe from two terminals 68 and 68' on the top of the safe. The terminals are shielded by a four-sided shield 64. Each terminal normally has a shorting cap on it. Adhesive cable clamps 70 are placed on the left inside wall of the safe to hold the cables 66 and 66'. Leads 72 and 772' from the cables 66 and 66' are drawn off to a piston motor 74 for each tank 32. The piston motor 74 contains a piston inside a threaded portion 76 which screws into the threaded hole 40 in the side of the release port collar 38. The piston motor contains a piston, an explosive charge and a hot wire detonator. The piston motor 74 may be the Model X50-5932 sold by Unidynamics Phoenix, Inc., of St. Louis, Mo. The hole 40 in the collar is located so that the piston, when extruded, will hit the edge of the prestressed glass 54. The cabling and piston motor are schematically illustrated in FIG. 8. Before screwing the piston motor into the threaded hole, the piston motor threads should be coated with silicone jelly to provide fluidproofing.

Figure 9:
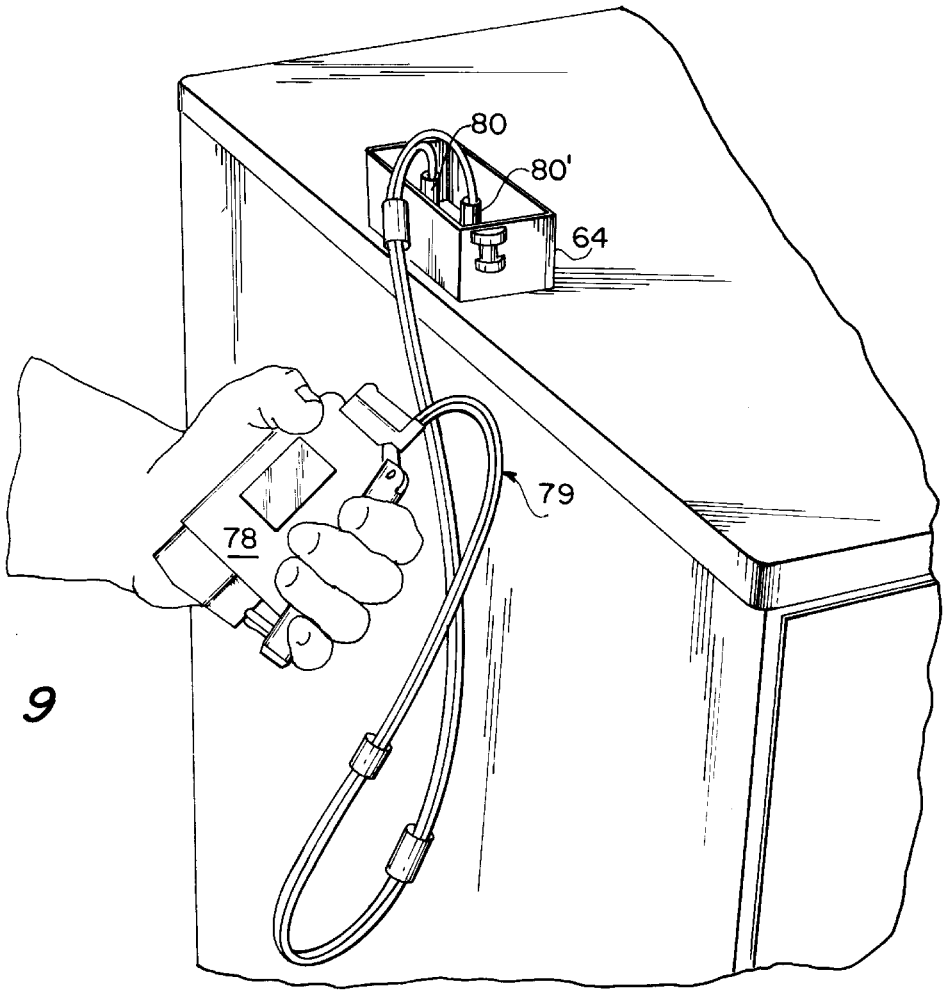
FIG. 9 is an isometric view of the electric impulse generator and its connection to the terminals on the safe.

The final component (FIG. 9) is an electrical impulse generator 78, or blasting machine, which generates a pulse of electrical current when it is squeezed. This is a commercial item and is purchaseable from Unidynamics Phoenix, Inc. Either model No. 7107-4 or XM-4 may be used.

To emergency destruct, the shorting caps are removed from the safe terminals. The terminals 80 and 80' on the cables 79 from the generator 78 are fitted into the terminals on the safe top. The generator 78 is then squeezed sending an impulse of current the detonator wire in each piston motor. The wire heats up and detonates its charge. The resulting explosion drives the piston into the edge of the prestressed glass which shatters the glass. The spring fingers 48 then force the shattered glass down into the storage tray area, opening the release port. The fluid in the tank drops through the release port and floods the storage tray area, dissolving the spacers 18 and allowing the microfiche-bearing cards 26 space to swell. The fluid then dissolves the emulsion on the microfiches destroying any information which the films contained.

The purpose of the styrofoam spacers is to reserve space in the storage tray for the destruct process. Upon contact with methylene chloride the microfiche swells. If a drawer were filled only with microfiche and flooded with the chemical, the microfiche would swell, become compacted and prevent dissolution of the film emulsion. It is therefore essential that space be available to compensate for the swelling of film.

Upon release of the chemical the styrofoam spacers dissolve rapidly to provide the required space. Except in a sparsely filled tray, the microfiche do not fall over. They tend to retain their vertical orientation which facilitates penetration of the chemical between adjacent microfiche cards.

Although the liner 24 is desirable in order to protect the drawer in which it sits, it is not necessary to the invention if the drawer is fluidtight. The storage tray 10 could be made somewhat larger to fit the drawer and the dissolving fluid could be dropped into the drawer. A larger volume of fluid would then then be necessary.

The spring 46 should be made of springy material such as beryllium copper of 0.02 inches thickness, for example.

The tank retainer may be of aluminum or, perhaps, ⅛-inch, 12 gauge, cold-rolled steel, for example.

The glass disc may be Corning Glass's Chemcor prestressed glass of 0.105 inches thickness and 2 ⅞-inch outer diameter, which has been kept in its salt bath about 24 hours.

The retaining collar on the tank may be of stainless steel or of free-cutting brass such as Alloy 360, for example. Typical dimensions are 3 ⅞-inch outer diameter, 2 ⅞-inch inner diameter and thickness of about 0.225 inches.

The gaskets may be 2 ⅞-inch outside diameter, 2-inch inside diameter, and 0.015-inch thickness.

The microfiche storage tray may be made, for example, from anodized aluminum ⅛-inch in thickness. The side strips may be of ⅛-inch aluminum and the top strip of 3⁄32-inch aluminum. The drawer liner may be of 1⁄16-inch aluminum, for example. The liner may have handles of 15⁄16-inch round steel, for example, if it is so desired.

The rubber padding may be ½-inch thick neoprene close-cell sponge sold by the B. F. Goodrich Co., for example. And the cement used to glue it to the back of the safe may, for example, be Neoprene Adhesive F-1 sold by Carboline of St. Louis, Mo.

Obviously, many modifications and variations of the present invention are possible in light of the above teachings. It is therefore to be understood that, within the scope of the appended claims, the invention may be practiced otherwise than as specifically described.

What is claimed is:

1. An emergency destruct system for microfiches contained within a drawer of a security container, the drawer having its back side cut away and the security container having a pad of rubber adhered to the back of the container covering the area which was adjacent to the cut away portion and making the drawer fluidtight when the drawer is in its closed position, said system comprising:

storage-tray means for storing cards bearing microfiches thereon, said tray means having a closed front, bottom and back but having sides comprising only a strip which otherwise leaves the side open, said tray means being located at the bottom of said drawer;

spacers located within the tray means to form compartments for storing said cards;

tank means for holding a fluid capable of dissolving the emulsion on said microfiches, the spacers being made of material which also is dissolved by said fluid thereby allowing said cards to fall flat, said tank means being formed with a release port opening and a closeable filling port opening therein and having release port means for releasing said fluid therefrom;

tank-retaining means mounted on the security container so as to be located above the tray means, said tank means being held by said retaining means above the tray means with its release port means facing the tray means; and actuation means for opening said release port means whereby said dissolving fluid is dropped upon said tray means to fill said tray means and to dissolve the emulsion on said microfiches.

2. A system as in claim 1, wherein said fluid is methylene chloride and said spacers are fabricated from styrofoam.

3. A system as in claim 1, wherein said release port means comprises, in order:

a collar having an inner and outer wall and fitting around said release port opening so that a shoulder is formed between the periphery of said opening and the inner wall of said collar, said collar being formed with a hole extending from its inner to its outer wall;

a first gasket formed with a central hole therein which corresponds in size to the size of the release port opening, said gasket being in contact with said shoulder;

a spring having the shape of said first gasket and also having several equally spaced spring fingers extending upwardly and inwardly from its gasket-shaped portion, the fingers being on the side of the spring farthest away from said release port opening, said spring being in contact with said first gasket;

a second gasket shaped like the first and being in contact with the gasket portion of said spring on the spring-finger side;

a flat piece of prestressed glass shaped to cover said release port opening and said second gasket, said glass being in contact with said second gasket;

a third gasket shaped like the first and being in contact with said glass; and retaining means shaped to fit inside said collar and to be affixed to the inner wall thereof and formed with a hole therein of the same size as the size of said release port opening, said retaining means being adapted to press down said gaskets, spring and glass into a minimum volume wherein said spring fingers lie flat and the edge of said flat piece of glass lies next to said hole through the walls of said collar.

4. A system as in claim 1, further including a liner having a front, a bottom, two sides and a rear, the sides extending backwards far enough to make snug contact with said rubber pad and extending outwardly at the middle to form an upper space which is larger than the lower space, the size of the liner being such as to fit snugly within said drawer, the size of the lower space of the liner being such as to snugly accommodate said storage-tray means, the size of the upper space of the liner being such as to accommodate said tank, the back of said liner being excised in the tank area so that, when the drawer is pulled out, the back of the liner does not contact the tank, and the liner being made of material which is impervious to chemical action of the dissolving fluid.

5. A system as in claim 3, wherein said actuation means comprises:

an explosive piston motor having a piston within a piston case which fits within said hole in said collar, a charge of explosive next to said piston and a resistance wire within said explosive charge;

a pair of leads extending from said resistance wire to the outside wall of said security container; and an electrical impulse generator of the type operated by a squeeze, said generator being connectible to said pair of leads so that, when it is squeezed, a pulse of current goes through said resistance wire, heating it and exploding said charge which forces the piston sharply against the edge of said prestressed glass to shatter the glass, thereby allowing said spring fingers to disperse the glass into said storage-tray means, whereupon the dissolving fluid is allowed to flow into said tray means.

6. A system as in claim 3, wherein the inner wall of said collar is threaded, said release port opening is circular, said gaskets are ring-shaped, said spring has a ring-shaped portion to which the fingers attach and the fingers are arcuately shaped, said glass is a circular disc, and said retaining means is a ring with an outer wall threaded to fit the threads of the inner wall of said collar, the outer diameters of the gaskets, spring, glass disc and retaining means being slightly smaller than the diameter of the inner wall of said collar so that they all fit inside said collar.

7. A system as in claim 6, wherein said actuation means comprises:

an explosive piston motor having a piston with a piston case which fits within said hole in said collar, a charge of explosive next to said piston and a resistance wire within said explosive charge;

a pair of leads extending from said resistance wire to the outside wall of said security container; and an electrical impulse generator of the type operated by a squeeze, said generator being connectible to said pair of leads so that, when it is squeezed, a pulse of current goes through said resistance wire, heating it and exploding said charge which forces the piston sharply against the edge of said prestressed glass to shatter the glass, thereby allowing said spring fingers to disperse the glass into said storage-tray means, whereupon the dissolving fluid is allowed to flow into said tray means.

* * * * *